US006059962A

United States Patent [19]

Alexander et al.

[11] Patent Number: 6,059,962

[45] Date of Patent: May 9, 2000

[54] MULTIPLE STAGE SULFUR REMOVAL PROCESS

[75] Inventors: Bruce D. Alexander, Lombard; George A. Huff, Naperville; Vivek R. Pradhan, Aurora; William J. Reagan; Roger H. Cayton, both of Naperville, all of Ill.

[73] Assignee: BP Amoco Corporation, Chicago, Ill.

[21] Appl. No.: 09/150,451

[22] Filed: Sep. 9, 1998

[51] Int. Cl.[7] ..... C10G 29/00; C10G 29/20

[52] U.S. Cl. ..... 208/238; 208/208 R; 208/237

[58] Field of Search ..... 208/208 R, 237, 208/238

[56] References Cited

U.S. PATENT DOCUMENTS

| | | | |
|---|---|---|---|
| 2,429,575 | 10/1947 | Appleby et al. | 260/683.6 |
| 2,448,211 | 8/1948 | Caesar et al. | 260/329 |
| 2,469,823 | 5/1949 | Hansford et al. | 260/329 |
| 2,482,084 | 9/1949 | Caesar et al. | 260/329 |
| 2,527,794 | 10/1950 | Caesar et al. | 260/329 |
| 2,529,298 | 11/1950 | Kreuz et al. | 260/329 |
| 2,531,280 | 11/1950 | Kreuz | 260/329 |
| 2,563,087 | 8/1951 | Vesely | 260/329 |
| 2,570,542 | 10/1951 | Gerald et al. | 260/329 |
| 2,677,648 | 5/1954 | Lien et al. | 196/28 |
| 2,843,639 | 7/1958 | Langlois et al. | 260/683.15 |
| 2,921,081 | 1/1960 | Zimmerschied et al. | 260/329 |
| 2,943,094 | 6/1960 | Birch et al. | 260/329 |
| 2,999,807 | 9/1961 | Buningh et al. | 208/254 |
| 3,629,478 | 12/1971 | Haunschild | 260/677 A |
| 3,634,534 | 1/1972 | Haunschild | 260/677 A |
| 4,171,260 | 10/1979 | Farcasiu et al. | 208/240 |
| 4,232,177 | 11/1980 | Smith, Jr. | 585/324 |
| 4,242,530 | 12/1980 | Smith, Jr. | 585/510 |
| 4,307,254 | 12/1981 | Smith, Jr. | 568/697 |
| 4,336,407 | 6/1982 | Smith, Jr. | 568/697 |
| 4,775,462 | 10/1988 | Imai et al. | 208/189 |
| 5,120,890 | 6/1992 | Sachtler et al. | 585/449 |
| 5,171,916 | 12/1992 | Le et al. | 585/467 |
| 5,243,115 | 9/1993 | Smith, Jr. et al. | 585/446 |
| 5,321,181 | 6/1994 | Smith, Jr. et al. | 585/467 |
| 5,336,820 | 8/1994 | Owen et al. | 585/323 |
| 5,510,568 | 4/1996 | Hearn | 585/834 |
| 5,597,476 | 1/1997 | Hearn et al. | 208/208 R |
| 5,599,441 | 2/1997 | Collins et al. | 208/208 R |
| 5,837,131 | 11/1998 | Clark | 208/216 |
| 5,863,419 | 1/1999 | Huff, Jr. et al. | 208/237 |

FOREIGN PATENT DOCUMENTS 0 359 874 A1 3/1990 European Pat. Off. .

WO 98/30655 7/1998 WIPO .

OTHER PUBLICATIONS

"Sulfuric Acid For Removing the Different Forms of Sulfur," *Oil and Gas Journal*, Nov. 10, 1938, p. 45.

W.G. Appleby et al., "Alkylation of Thiophene with Olefins," J. *Am. Chem. Soc.*, vol. 70, (1948), pp. 1552–1555.

G.E. Mapstone, "The Chemistry of the Acid Treatment of Gasoline," *Petroleum Refiner*, vol. 29, No. 11 (Nov., 1950), pp. 142–150.

*Friedel–Crafts and Related Reactions*, G.A. Olah, Ed., Interscience Publishers, New York, vol. II, "Alkylation and Related Reactions, Part 1," (1964) pp. 104–109.

*Petroleum Processing Handbook*, W.F. Bland and R.L. Davidson, Ed., McGraw–Hill Book Company, New York, (1967), pp. 3–119 and 3–120.

F. Asinger, *Mono–Olefins*, Pergamon Press, Oxford (1968), p. 976.

*Primary Examiner*—Walter D. Griffin
*Attorney, Agent, or Firm*—Richard A. Kretchmer; Frank J. Sroak

[57] ABSTRACT

A product of reduced sulfur content is produced in a multiple stage process from a feedstock which is comprised of a mixture of hydrocarbons and includes sulfur-containing aromatic compounds as unwanted impurities. The first stage involves: (1) subjecting the feedstock to alkylation conditions which are effective to convert a portion of the impurities to higher boiling sulfur-containing products, and (2) separating the resulting products by fractional distillation into a lower boiling fraction and a higher boiling fraction. The lower boiling fraction is comprised of hydrocarbons and is of reduced sulfur content relative to the feedstock. The higher boiling fraction is comprised of hydrocarbons and contains unconverted sulfur-containing aromatic impurities and also the higher boiling sulfur-containing products. Each subsequent stage involves: (1) subjecting the higher boiling fraction from the preceding stage to alkylation conditions which are effective to convert at least a portion of its content of sulfur-containing aromatic compounds to higher boiling sulfur-containing products, and (2) separating the resulting products by fractional distillation into a lower boiling hydrocarbon fraction and a higher boiling fraction which contains higher boiling sulfur-containing alkylation products. The total hydrocarbon product of reduced sulfur content from the process is comprised of the lower boiling fractions from various stages.

21 Claims, 2 Drawing Sheets

MULTIPLE STAGE SULFUR REMOVAL PROCESS

FIELD OF THE INVENTION

This invention relates to a process for producing a product of reduced sulfur content from a feedstock wherein the feedstock is comprised of a mixture of hydrocarbons and contains sulfur-containing aromatic compounds, such as thiophenic and benzothiophenic compounds, as unwanted impurities. More particularly, the invention relates to a multiple stage process for converting these impurities to higher boiling products by alkylation and removing the higher boiling products by fractional distillation.

BACKGROUND OF THE INVENTION

The fluidized catalytic cracking process is one of the major refining processes which is currently employed in the conversion of petroleum to desirable fuels such as gasoline and diesel fuel. In this process, a high molecular weight hydrocarbon feedstock is converted to lower molecular weight products through contact with hot, finely-divided, solid catalyst particles in a fluidized or dispersed state. Suitable hydrocarbon feedstocks typically boil within the range of from about 205° C. to about 650° C., and they are usually contacted with the catalyst at temperatures in the range from about 450° C. to about 650° C. Suitable feedstocks include various mineral oil fractions such as light gas oils, heavy gas oils, wide-cut gas oils, vacuum gas oils, kerosenes, decanted oils, residual fractions, reduced crude oils and cycle oils which are derived from any of these as well as fractions derived from shale oils, tar sands processing, and coal liquefaction. Products from a fluidized catalytic cracking process are typically based on boiling point and include light naphtha (boiling between about 10° C. and about 221° C.), heavy naphtha (boiling between about 10° C. and about 249° C.), kerosene (boiling between about 180° C. and about 300° C.), light cycle oil (boiling between about 221° C. and about 345° C.), and heavy cycle oil (boiling at temperatures higher than about 345° C.).

Not only does the fluidized catalytic cracking process provide a significant part of the gasoline pool in the United States, it also provides a large proportion of the sulfur that appears in this pool. The sulfur in the liquid products from this process is in the form of organic sulfur compounds and is an undesirable impurity which is converted to sulfur oxides when these products are utilized as a fuel. These sulfur oxides are objectionable air pollutants. In addition, they can deactivate many of the catalysts that have been developed for the catalytic converters which are used on automobiles to catalyze the conversion of harmful engine exhaust emissions to gases which are less objectionable. Accordingly, it is desirable to reduce the sulfur content of catalytic cracking products to the lowest possible levels.

The sulfur-containing impurities of straight run gasolines, which are prepared by simple distillation of crude oil, are usually very different from those in cracked gasolines. The former contain mostly mercaptans and sulfides, whereas the latter are rich in thiophene, benzothiophene and derivatives of thiophene and benzothiophene.

Low sulfur products are conventionally obtained from the catalytic cracking process by hydrotreating either the feedstock to the process or the products from the process. The hydrotreating process involves treatment with hydrogen in the presence of a catalyst and results in the conversion of the sulfur in the sulfur-containing impurities to hydrogen sulfide, which can be separated and converted to elemental sulfur. Unfortunately, this type of processing is typically quite expensive because it requires a source of hydrogen, high pressure process equipment, expensive hydrotreating catalysts, and a sulfur recovery plant for conversion of the resulting hydrogen sulfide to elemental sulfur. In addition, the hydrotreating process can result in an undesired destruction of olefins in the feedstock by converting them to saturated hydrocarbons through hydrogenation. This destruction of olefins by hydrogenation is usually undesirable because it results in the consumption of expensive hydrogen, and also because the olefins are valuable as high octane components of gasoline. As an example, naphtha of a gasoline boiling range from a catalytic cracking process has a relatively high octane number as a result of a large olefin content. Hydrotreating such a material causes a reduction in the olefin content in addition to the desired desulfurization, and the octane number of the hydrotreated product decreases as the degree of desulfurization increases.

U.S. Pat. No. 2,448,211 (Caesar et al.) discloses that thiophene and its derivatives can be alkylated by reaction with olefinic hydrocarbons at a temperature between about 140° and about 400° C. in the presence of a catalyst such as an activated natural clay or a synthetic adsorbent composite of silica and at least one amphoteric metal oxide. Suitable activated natural clay catalysts include clay catalysts on which zinc chloride or phosphoric acid have been precipitated. Suitable silica-amphoteric metal oxide catalysts include combinations of silica with materials such as alumina, zirconia, ceria, and thoria. U.S. Pat. No. 2,469,823 (Hansford et al.) teaches that boron trifluoride can be used to catalyze the alkylation of thiophene and alkyl thiophenes with alkylating agents such as olefinic hydrocarbons, alkyl halides, alcohols, and mercaptans. In addition, U.S. Pat. No. 2,921,081 (Zimmerschied et al.) discloses that acidic solid catalysts can be prepared by combining a zirconium compound selected from the group consisting of zirconium dioxide and the halides of zirconium with an acid selected from the group consisting of orthophosphoric acid, pyrophosphoric acid, and triphosphoric acid. The Zimmerschied et al. reference also teaches that thiophene can be alkylated with propylene at a temperature of 227° C. in the presence of such a catalyst.

U.S. Pat. No. 2,563,087 (Vesely) discloses that thiophene can be removed from aromatic hydrocarbons by selective alkylation of the thiophene and separation of the resulting thiophene alkylate by distillation. The selective alkylation is carried out by mixing the thiophene-contaminated aromatic hydrocarbon with an alkylating agent and contacting the mixture with an alkylation catalyst at a carefully controlled temperature in the range from about −20° C. to about 85° C. It is disclosed that suitable alkylating agents include olefins, mercaptans, mineral acid esters, and alkoxy compounds such as aliphatic alcohols, ethers and esters of carboxylic acids. It is also disclosed that suitable alkylation catalysts include the following: (1) the Friedel-Crafts metal halides, which are preferably used in anhydrous form; (2) a phosphoric acid, preferably pyrophosphoric acid, or a mixture of such a material with sulfuric acid in which the volume ratio of sulfuric to phosphoric acid is less than about 4:1; and (3) a mixture of a phosphoric acid, such as orthophosphoric acid or pyrophosphoric acid, with a siliceous adsorbent, such as kieselguhr or a siliceous clay, which has been calcined to a temperature of from about 400° to about 500° C. to form a silico-phosphoric acid combination which is commonly referred to as a solid phosphoric acid catalyst.

U.S. Pat. No. 5,171,916 (Le et al.) is directed to a process for upgrading a light cycle oil by: (1) alkylating the heteroatom containing aromatics of the cycle oil with an aliphatic hydrocarbon having at least one olefinic double bond through the use of a crystalline metallosilicate catalyst; and (2) separating the high boiling alkylation product by fractional distillation. It is disclosed that the unconverted light cycle oil has a reduced sulfur and nitrogen content, and the high boiling alkylation product is useful as a synthetic alkylated aromatic functional fluid base stock.

U.S. Pat. No. 5,599,441 (Collins et al.) discloses a process for removing thiophenic sulfur compounds from a cracked naphtha by: (1) contacting the naphtha with an acid catalyst in an alkylation zone to alkylate the thiophenic compounds using the olefins present in the naphtha as an alkylating agent; (2) removing an effluent stream from the alkylation zone; and (3) separating the alkylated thiophenic compounds from the alkylation zone effluent stream by fractional distillation. It is also disclosed that additional olefins can be added to the cracked naphtha to provide additional alkylating agent for the process.

SUMMARY OF THE INVENTION

Hydrocarbon liquids which boil over either a broad or a narrow range of temperatures within the range from about 10° C. to about 345° C. are referred to herein as "distillate hydrocarbon liquids." Such liquids are frequently encountered in the refining of petroleum and also in the refining of products from coal liquefaction and the processing of oil shale or tar sands, and these liquids are typically comprised of a complex mixture of hydrocarbons. For example, light naphtha, heavy naphtha, gasoline, kerosene and light cycle oil are all distillate hydrocarbon liquids.

Distillate hydrocarbon liquids which are encountered in a refinery frequently contain undesirable sulfur-containing impurities which must be at least partially removed. Hydrotreating procedures are effective and are commonly used for removing sulfur-containing impurities from distillate hydrocarbon liquids. Unfortunately, hydrotreating is an expensive process and is usually unsatisfactory for use with highly olefinic distillate hydrocarbon liquids. Accordingly, there is a need for an inexpensive process for the effective removal of sulfur-containing impurities from distillate hydrocarbon liquids. There is also a need for such a process which can be used to remove sulfur-containing impurities from distillate hydrocarbon liquids, such as products from a fluidized catalytic cracking process, which are highly olefinic and contain both thiophenic and benzothiophenic compounds as unwanted impurities.

Organic sulfur compounds can be removed from distillate hydrocarbon liquids by: (1) conversion of the sulfur compounds to products of higher boiling point by alkylation; and (2) removal of the higher boiling products by fractional distillation. This type of sulfur removal process is referred to herein as an "alkylation/fractionation desulfurization process." Although such a process is quite effective, it is better with some feedstocks than with others. For example, when applied to a feedstock which contains a significant amount of aromatic hydrocarbons, such as a naphtha from a catalytic cracking process, alkylation of aromatic hydrocarbons in the naphtha is a reaction which competes with the desired alkylation of sulfur-containing impurities. This competing alkylation of aromatic hydrocarbons is ordinarily undesirable because a significant portion of the alkylated aromatic hydrocarbon products will have undesirably high boiling points and will be rejected by the process together with the high boiling point alkylated sulfur-containing impurities. Fortunately, many typical sulfur-containing impurities are alkylated more rapidly than aromatic hydrocarbons. Accordingly, the sulfur-containing impurities can, to a limited degree, be selectively alkylated. However, the competing alkylation of aromatic hydrocarbons makes it essentially impossible to achieve a substantially complete removal of the sulfur-containing impurities without a simultaneous and undesired removal of significant amounts of aromatic hydrocarbons.

In those cases where an olefin or a mixture of olefins is used as the alkylating agent in the practice of the alkylation/fractionation desulfurization process, olefin polymerization will also compete, as an undesired side reaction, with the desired alkylation of sulfur-containing impurities. As a consequence of this side reaction, it is frequently not possible to achieve high conversion of the sulfur-containing impurities to alkylation products without a significant conversion of olefinic alkylating agent to polymeric by-products. Such a loss of olefins can be very undesirable as, for example, when an olefinic naphtha of gasoline boiling range is to be desulfurized and the resulting product used as a gasoline blending stock. In this example, $C_6$ through $C_{10}$ olefins, which are of high octane and in the gasoline boiling range, can be converted to high-boiling polymeric by-products under severe alkylation conditions and thereby lost as gasoline components.

We have discovered that the loss of aromatic hydrocarbons from a feedstock, which is subjected to the removal of sulfur-containing aromatic impurities by an alkylation/fractionation desulfurization process, can be minimized by carrying out the process in a series of two or more stages. We have also discovered that the loss of $C_6$ through $C_{10}$ olefins through conversion to undesired by-products can also be minimized through the use of a series of two or more stages. The invention involves subjecting the feedstock to an alkylation/fractionation desulfurization process in a first stage to give: (1) a low boiling fraction of reduced sulfur content; and (2) a higher boiling fraction, wherein the higher boiling fraction contains as impurities some of the unalkylated and less reactive sulfur-containing aromatic compounds from the feedstock. Each subsequent stage involves subjecting the higher boiling fraction from the preceding stage to an alkylation/fractionation desulfurization process to give a lower and a higher boiling fraction. The product of reduced sulfur content from the multiple stage process is comprised of the lower boiling fractions from the various stages.

One embodiment of the invention is a process for producing products of reduced sulfur content from a feedstock, wherein said feedstock is comprised of a mixture of hydrocarbons which includes olefins, and wherein the feedstock contains sulfur-containing aromatic compounds as impurities; said process comprising:

(a) in a first contacting step, contacting the feedstock with an acidic catalyst under conditions which are effective to convert a portion of the impurities to a sulfur-containing material of higher boiling point through alkylation by the olefins;

(b) in a first fractionation step, fractionating the product of said first contacting step on the basis of boiling point into at least two fractions which include:

(i) a first fraction which is comprised of hydrocarbons and has a reduced sulfur content relative to that of said feedstock; and (ii) a second fraction which is comprised of hydrocarbons, has a higher boiling point than that of said first fraction and contains sulfur-containing aromatic compounds as impurities;

(c) withdrawing said first fraction from the process as a first product stream of reduced sulfur content;

(d) preparing a secondary process stream by combining said second fraction with a secondary alkylating agent which is comprised of at least one material selected from the group consisting of alcohols and olefins, and wherein said secondary alkylating agent is in addition to any olefins present in the second fraction;

(e) in a second contacting step, contacting the secondary process stream with an acidic catalyst under conditions which are effective to convert at least a portion of the sulfur-containing aromatic compounds in said secondary process stream to a sulfur-containing material of higher boiling point;

(f) in a second fractionation step, fractionating the product of said second contacting step on the basis of boiling point to remove high boiling sulfur-containing material in a high boiling fraction and produce a lower boiling fraction; and (g) withdrawing the lower boiling fraction from the second fractionation step as a second product stream of reduced sulfur content.

An object of the invention is to provide an improved alkylation/fractionation desulfurization process wherein by-product formation is minimized.

An object of the invention is to provide an improved alkylation/fractionation desulfurization process wherein the formation of undesired oligomers and polymers from the polymerization of olefinic alkylating agents is minimized.

An object of the invention is to provide an improved alkylation/fractionation desulfurization process which can be applied to a feedstock which contains volatile aromatic hydrocarbons without causing a significant loss of such hydrocarbons.

Another object of the invention is to provide an improved method for the efficient removal of thiophenic and benzothiophenic impurities from an olefinic cracked naphtha which does not significantly reduce the naphtha's octane.

A further object of the invention is to provide an inexpensive process for the efficient removal of thiophenic and benzothiophenic impurities from a hydrocarbon feedstock.

DETAILED DESCRIPTION OF THE INVENTION

Figure 1:
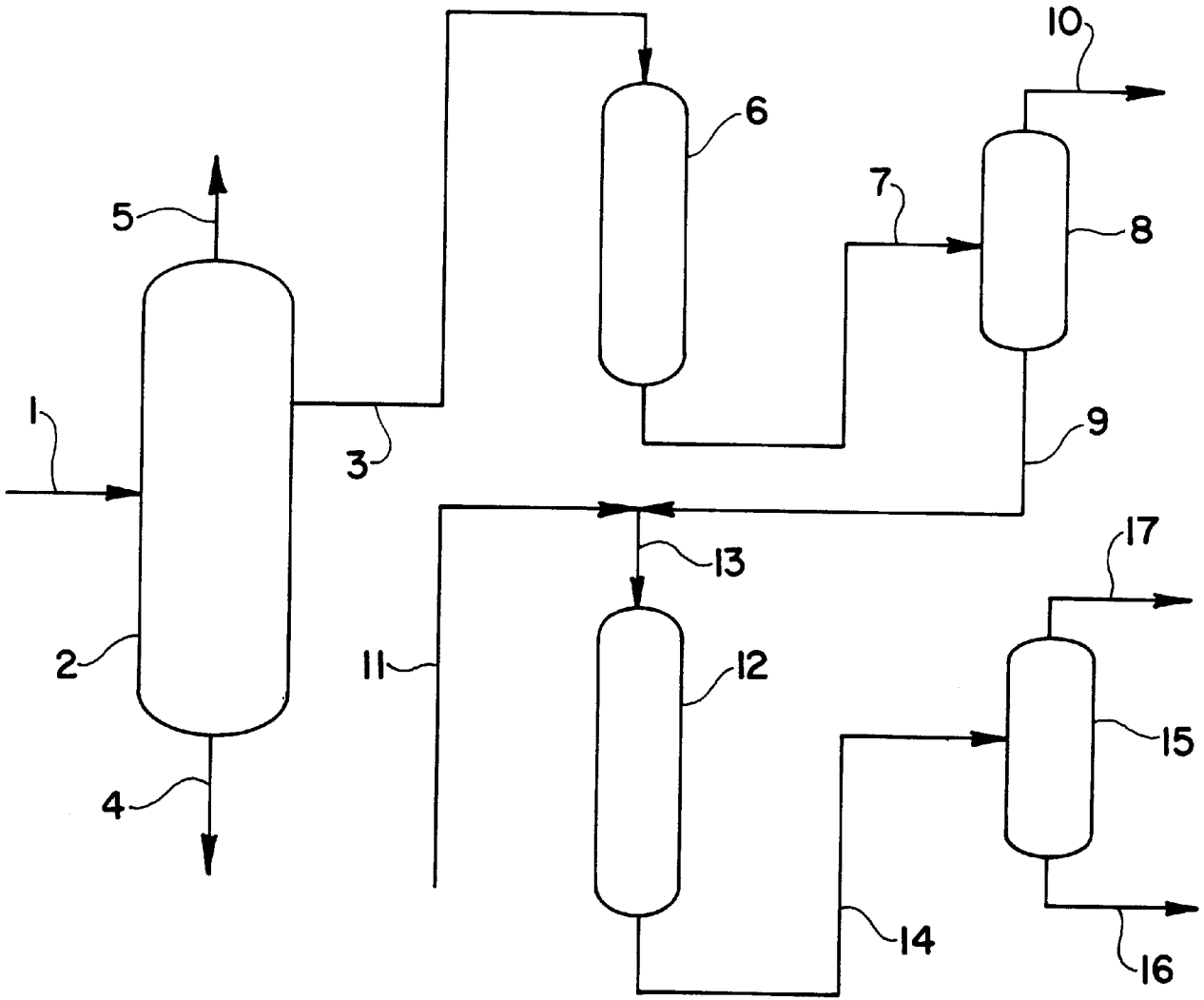
FIG. 1 of the drawings is a schematic representation of one embodiment of the invention.

We have discovered a process for the production of a product of reduced sulfur content from a feedstock which is comprised of a mixture of hydrocarbons and contains sulfur-containing aromatic compounds, such as thiophenic and benzothiophenic compounds, as unwanted impurities. The invention involves the use of a series of at least two alkylation/fractionation desulfurization stages. Most of the more volatile sulfur-containing aromatic impurities are removed in the first stage, and less volatile sulfur-containing aromatic impurities are removed in at least one subsequent stage.

As used herein, the terms "sulfur-containing aromatic compound" and "sulfur-containing aromatic impurity" refer to any aromatic organic compound which contains at least one sulfur atom in its aromatic ring system. Such materials include thiophenic and benzothiophenic compounds, and examples of such material include but are not limited to thiophene, 2-methylthiophene, 3-methylthiophene, 2,3-dimethylthiophene, 2,5-dimethylthiophene, 2-ethylthiophene, 3-ethylthiophene, benzothiophene, 2-methylbenzothiophene, 2,3-dimethylbenzothiophene, and 3-ethylbenzothiophene.

The first stage of the invention involves: (1) subjecting the feedstock to alkylation conditions which are effective to convert a portion of the impurities to higher boiling sulfur-containing products, and (2) separating the resulting products by fractional distillation into a lower boiling fraction and a higher boiling fraction. The lower boiling fraction is comprised of hydrocarbons and is of reduced sulfur content relative to the feedstock. The higher boiling fraction is comprised of hydrocarbons and contains unalkylated sulfur-containing aromatic impurities and also the higher boiling sulfur-containing products. In the first stage alkylation step, the feedstock is subjected to alkylation conditions which are effective to convert the more reactive impurities to higher boiling sulfur-containing products which can be separated by fractional distillation. We have discovered that the more reactive impurities are usually the more volatile of the impurities, such as thiophene and various low molecular weight alkyl-substituted thiophenes. The alkylation conditions in this first stage alkylation step can be selected so that they are mild enough to result in substantial alkylation of the volatile sulfur-containing aromatic impurities without causing significant alkylation of aromatic hydrocarbons or undesired olefin polymerization.

Any lower boiling aromatic hydrocarbons and olefinic hydrocarbons in the first stage alkylation product are removed by fractional distillation in the lower boiling fraction. Since the more reactive sulfur-containing aromatic impurities in the feedstock are usually the more volatile ones, most of these more volatile impurities will be converted to higher boiling material in the first stage alkylation step, and the lower boiling fraction will have a substantially reduced concentration of sulfur-containing aromatic impurities relative to the feedstock. The higher boiling fraction will contain alkylated sulfur-containing aromatic impurities and also a large portion of the less reactive of the sulfur-containing aromatic impurities which did not undergo alkylation in the first stage alkylation step. The unalkylated impurities will typically include multisubstituted thiophenes, benzothiophene and substituted benzothiophenes.

Each subsequent stage of the invention, which is referred to herein as a secondary stage, involves: (1) subjecting the higher boiling fraction from the preceding stage to alkylation conditions which are effective to convert at least a portion of its content of sulfur-containing aromatic compounds to higher boiling sulfur-containing products, and (2) separating the resulting products by fractional distillation into a lower boiling fraction and a higher boiling fraction. In a preferred embodiment of the invention, only one secondary stage will be used. The lower boiling fraction from the secondary stage is comprised of hydrocarbons and is of reduced sulfur content relative to the feedstock. The higher boiling fraction from the secondary stage is comprised of the higher boiling sulfur-containing products from the preceding alkylation steps. In the secondary stage alkylation step, alkylation conditions are used which are effective to convert at least a portion of the sulfur-containing aromatic impurities in the feed to this stage to higher boiling sulfur-containing products which can be separated by fractional distillation. The sulfur-containing aromatic impurities in the feed to the secondary stage include unalkylated sulfur-containing aromatic impurities from the preceding stage or stages and also alkylated sulfur-containing aromatic impurities from the preceding stage or stages. The alkylated impurities from the preceding stage or stages will sometimes be of sufficiently high volatility that further alkylation will be necessary in order to increase their boiling point enough to permit their removal by fractional distillation. In addition, alkylation of the unalkylated impurities will be necessary to permit their removal by fractional distillation.

In one embodiment of the process of this invention, the feedstock to the first stage will contain benzothiophene as one of the sulfur-containing aromatic impurities, and the high boiling fraction from said first stage, which is subjected to alkylation conditions in a secondary stage, will include a major portion of said benzothiophene.

The total product from the process of this invention is comprised of the combined low boiling fractions from the various stages of the process, and the total product will be of reduced sulfur content relative to that of the feedstock to the process. However, the low boiling fraction from each stage of the process is a separate product stream which can be used independently of any other product stream from the process.

The distillation endpoint of the low boiling fraction from the first stage of the invention is desirably chosen to be such that it is below the temperature at which substantial amounts of benzothiophene are distilled. Since the boiling point of benzothiophene is 221° C., the distillation endpoint of this low boiling fraction will typically be selected such that it is below about 221° C. However, we have found that benzothiophene can form low boiling azeotropes with some of the components of the distillate hydrocarbon liquids in which it typically occurs as an impurity. Because of such azeotrope formation, the distillation endpoint of the low boiling first stage fraction will be preferably below about 199° C. and more preferably below about 190° C. A desirable distillation endpoint for the low boiling first stage fraction will be in the range from about 135° to about 221° C., since this will serve to exclude benzothiophenic compounds and also some multisubstituted thiophenes, such as certain 2,5-dialkylthiophenes, which are usually difficult to alkylate. A highly desirable distillation endpoint for the low boiling first stage fraction will be in the range from about 150° to about 190° C.

In the practice of this invention, it is believed that the principal mechanism for conversion of the sulfur-containing aromatic impurities to higher boiling products involves the alkylation of these impurities with the alkylating agent. By way of example, simple alkylation of a sulfur-containing aromatic compound such as thiophene would yield an alkyl-substituted thiophene. This type of reaction is illustrated in the following equation, wherein the conversion of thiophene to 2-isopropylthiophene is illustrated using propene as the alkylating agent.

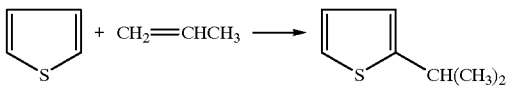

It will be appreciated, of course, that monoalkylation of thiophene can take place either α or β to the sulfur atom, and that polyalkylation can also take place. The alkylation process results in the substitution of an alkyl group for a hydrogen atom in the sulfur-containing starting material and causes a corresponding increase in molecular weight over that of the starting material. The higher molecular weight of such an alkylation product is reflected by a higher boiling point relative to that of the starting material.

We have found that many of the more volatile sulfur-containing aromatic impurities are much more reactive as alkylation substrates in comparison to many of the less volatile sulfur-containing aromatic impurities which are found in conventional refinery process streams such as olefinic naphthas from a catalytic cracking process. As set forth in Example VI, we have found the following relative reactivities toward acid catalyzed alkylation by 1-heptene at 204° C. over a solid phosphoric acid catalyst: thiophene (84° C.)>2-methylthiophene (113° C.)>>benzothiophene (221° C.)>2,5-dimethylthiophene (137° C.)>toluene (111° C.)>benzene (80° C.), where the boiling point of each compound is set forth in parenthesis. It is believed that alkylation of thiophenic compounds preferentially occurs at one of the thiophene ring positions directly adjacent to the sulfur (identified as positions 2 and 5). Accordingly, a thiophene like 2,5-dimethylthiophene, which is substituted at both the 2 and the 5 positions, would be expected to be less reactive than thiophenes which have at least one of these positions vacant. However, it is believed that most thiophenic compounds which are unsubstituted at either the 2 or the 5 position will be much more reactive than benzothiophene or alkyl-substituted benzothiophenes. Accordingly, the staged process of this invention takes advantage of the typically higher reactivity of the more volatile sulfur-containing aromatic compounds.

The alkylation conditions in the alkylation step of each stage of the invention can be optimized to achieve the desired alkylation of sulfur-containing aromatic impurities and to minimize undesired side reactions such as the alkylation of aromatic hydrocarbons and olefin polymerization. In a highly preferred embodiment, this optimization will involve the use of mild alkylation conditions in the alkylation step of the first stage and more vigorous alkylation conditions in the alkylation step of the secondary stages. The parameters that can be adjusted to control the severity of the alkylation process include but are not limited to temperature, selection of catalyst, type of alkylating agent, and concentration of alkylating agent.

Alkylation conditions which are less severe in the first stage alkylation step than in the alkylation step of a secondary stage can be achieved, for example, through the use of a lower temperature in the first stage alkylation step as opposed to a higher temperature in a secondary stage alkylation step. In addition, a highly desirable method of increasing the severity of the alkylation conditions in the alkylation step of a secondary stage involves adding a low molecular weight alkylating agent. For example, olefins which contain from 3 to 5 carbon atoms are highly preferred for use as an added alkylating agent. Although such a low molecular weight olefin can undergo polymerization, the by-products that result from this polymerization will, in large part, comprise volatile oligomers which are in the gasoline boiling range. That is to say, if the product is intended as a gasoline blending stock, these oligomers will be a desirable high octane component of the product which will not be lost when the high-boiling sulfur-containing alkylation products are removed by fractionation. In this embodiment of the invention, the process stream that is subjected to alkylation conditions in the alkylation step of a secondary stage will desirably include from about 1 to about 50 vol. % and preferably from about 10 to about 50 vol. % of added alkylating agent which is comprised of at least one material selected from the group consisting of olefins of from 3 to 5 carbon atoms.

The use of mild alkylation conditions in the alkylation step of the first stage is possible because this stage is dedicated to a conversion of the more reactive and typically more volatile of the sulfur-containing aromatic impurities to higher boiling sulfur-containing products. As a consequence of these mild reaction conditions, side reactions such as the alkylation of aromatic hydrocarbons and olefin polymerization are minimized. Accordingly, volatile aromatic hydrocarbons, such as benzene, toluene, xylene, ethylbenzene and cumene in the feed undergo little conversion in the first stage. In addition, there will be relatively little loss of valuable olefins as a consequence of polymerization.

Volatile aromatic hydrocarbons are substantially removed from the high boiling first stage fraction that is used as the feed to the following secondary stage of the invention. Since these materials are not present, they are not subjected to the more vigorous alkylation conditions which are preferred in the alkylation step of the secondary stage.

Suitable alkylating agents for use in the practice of this invention include both olefins and alcohols, and these alkylating agents will desirably contain from 3 to about 20 carbon atoms. However, olefins are generally preferred since they are usually more reactive than alcohols and can be used in the subject process under milder reaction conditions. Materials such as ethylene, methanol and ethanol are less useful than most other olefins and alcohols as alkylating agents in the practice of this invention because of their relatively low reactivity.

Suitable olefins for use as alkylating agents include cyclic olefins, substituted cyclic olefins, and olefins of formula I wherein $R_1$ is a hydrocarbyl group and each $R_2$ is independently selected from the group consisting of hydrogen and hydrocarbyl groups. Preferably, $R_1$ is an alkyl group and each $R_2$ is independently selected from

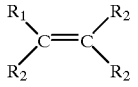

(I)

the group consisting of hydrogen and alkyl groups. Examples of suitable cyclic olefins and substituted cyclic olefins include cyclopentene, 1-methylcyclopentene, cyclohexene, 1-methylcyclohexene, 3-methylcyclohexene, 4-methylcyclohexene, cycloheptene, cyclooctene, and 4-methylcyclooctene. Examples of suitable olefins of the type of formula I include propene, 2-methylpropene, 1-butene, 2-butene, 2-methyl-1-butene, 3-methyl-1-butene, 2-methyl-2-butene, 2,3-dimethyl-1-butene, 3,3-dimethyl-1-butene, 2,3-dimethyl-2-butene, 2-ethyl-1-butene, 2-ethyl-3-methyl-1-butene, 2,3,3-trimethyl-1-butene, 1-pentene, 2-pentene, 2-methyl-1-pentene, 3-methyl-1-pentene, 4-methyl-1-pentene, 2,4-dimethyl-1-pentene, 1-hexene, 2-hexene, 3-hexene, 1,3-hexadiene, 1,4-hexadiene, 1,5-hexadiene, 2,4-hexadiene, 1-heptene, 2-heptene, 3-heptene, 1-octene, 2-octene, 3-octene, and 4-octene. We have found that lower molecular weight olefins tend to be more reactive alkylating agents for use in the alkylation of thiophenic and benzothiophenic compounds. For example, in the application of the alkylation/fractionation desulfurization process to a heavy naphtha from a catalytic cracking process which has a boiling range from about 10° C. to about 249° C., we have found that of the olefins present as components of the naphtha, the lower molecular weight $C_5$ and $C_6$ olefins are more reactive than the higher molecular weight $C_7$+ olefins. We have also found that olefins which contain from 3 to 5 carbon atoms are highly satisfactory for use as the alkylating agent in the alkylation step of a secondary stage of the invention. Not only are these 3 to 5 carbon olefins highly reactive as alkylating agents, they also yield polymerization by-products which are usually less objectionable than those which are produced by higher molecular weight olefins. As stated above, by-products resulting from the polymerization of these 3 to 5 carbon atom olefins will, at least in part, comprise volatile dimers and trimers which contain from 6 to 10 carbon atoms and are in the gasoline boiling range. Accordingly, if the product is intended for use as a gasoline blending stock, these volatile oligomers will be a desirable high octane component of the product, and they will have a low enough boiling point that they will not be lost when the high boiling sulfur-containing alkylation products are removed by fractionation.

Preferred olefins for use as the alkylating agent in the alkylation step of the first stage in the practice of the invention include those olefins which contain from about 7 to about 15 carbon atoms. As noted above, these olefins tend to be somewhat less reactive than the lower molecular weight olefins which contain from 3 to 6 carbon atoms. Accordingly, they are quite suitable for use as the alkylating agent which is used in combination with the highly reactive sulfur-containing aromatic impurities in the alkylation step of the first stage. In addition, alkylating agents which contain a large number of carbon atoms will ordinarily yield higher boiling alkylation products than alkylating agents which contain a smaller number of carbon atoms.

As a very crude approximation, each carbon atom in the side chain of a monoalkylated thiophene adds about 25° C. to the 84° C. boiling point of thiophene. As an example, 2-octylthiophene has a boiling point of 259° C., which corresponds to a boiling point increase of 23° C. over that of thiophene for each carbon atom in the eight carbon alkyl group. Accordingly, monoalkylation of thiophene with a $C_7$ to $C_{15}$ olefin in the first alkylation stage of the invention will usually yield a sulfur-containing alkylation product which has a high enough boiling point to be easily removed by fractional distillation as a component of a high boiling fraction which has an initial boiling point of about 210° C. In contrast, if 2-methylpropene, a 4 carbon olefin, is used as the alkylating agent, monoalkylation would convert thiophene to 2-t-butylthiophene (b.p. 164° C.) and dialkylation would yield di-t-butylthiophene (b.p. about 224° C.). Accordingly, dialkylation with the 4 carbon olefin will be necessary to convert thiophene to a high boiling alkylated material that can be removed by fractional distillation as a component of a high boiling fraction which has an initial boiling point of about 210° C.

When an alcohol or a mixture of alcohols is used as an alkylating agent in the practice of the invention, secondary and tertiary alcohols are highly preferred over primary alcohols because they are usually more reactive than the primary alcohols and can be used under milder reaction conditions. Alcohols which contain from 3 to 5 carbon atoms are generally preferred.

Feedstocks which can be used in the practice of this invention are comprised of a mixture of hydrocarbons and contain a minor amount of sulfur-containing aromatic impurities such as thiophenic compounds and benzothiophenic compounds. In addition, the feedstock will be comprised of a liquid and desirably has a distillation endpoint which is about 345° C. or lower, and preferably about 249° C. or lower. If desired, the feedstock can have a distillation endpoint of about 221° C. or lower. Preferably, the feedstock will have an initial boiling point which is below about 79° C. Suitable feedstocks include any of the various complex mixtures of hydrocarbons which are conventionally encountered in the refining of petroleum such as natural gas liquids, naphtha, light gas oils, heavy gas oils, and wide-cut gas oils, as well as hydrocarbon fractions derived from coal liquefaction and the processing of oil shale or tar sands. Preferred feedstocks include olefinic naphthas which result from the catalytic cracking or coking of hydrocarbon feedstocks.

Catalytic cracking products are highly preferred feedstocks for use in the subject invention. Preferred feedstocks of this type include liquids which boil below about 345° C., such as light naphtha, heavy naphtha and light cycle oil. However, it will also be appreciated that the entire output of volatile products from a catalytic cracking process can be utilized as a feedstock in the subject invention. Catalytic cracking products are a desirable feedstock because they typically contain a relatively high olefin content, which usually makes it unnecessary to add any additional alkylating agent during the first alkylation stage of the invention. In addition, sulfur-containing aromatic compounds, such as thiophenic and benzothiophenic compounds, are frequently a major component of the sulfur-containing impurities in catalytic cracking products, and such impurities are easily removed by means of the subject invention. For example, a typical light naphtha from the fluidized catalytic cracking of a petroleum derived gas oil can contain up to about 60% by weight of olefins and up to about 0.5% by weight of sulfur wherein most of the sulfur will be in the form of thiophenic and benzothiophenic compounds. A preferred feedstock for use in the practice of this invention will be comprised of catalytic cracking products and will be additionally comprised of at least 1 weight percent of olefins. A highly preferred feedstock will be comprised of catalytic cracking products and will be additionally comprised of at least 5 weight percent of olefins. Such feedstocks can be a portion of the volatile products from a catalytic cracking process which is isolated by distillation.

In the practice of this invention, the feedstock will contain sulfur-containing aromatic compounds as impurities. In one embodiment of the invention, the feedstock will contain both thiophenic and benzothiophenic compounds as impurities. If desired, at least about 50% or even more of these sulfur-containing aromatic compounds can be converted to higher boiling sulfur-containing material in the practice of this invention. In one embodiment of the invention, the feedstock will contain benzothiophene, and at least about 50% of the benzothiophene will be converted to higher boiling sulfur-containing material by alkylation and removed by fractionation.

Any acidic material which can catalyze the alkylation of sulfur-containing aromatic compounds by olefins or alcohols can be used as a catalyst in the practice of this invention. Although liquid acids, such as sulfuric acid can be used, solid acidic catalysts are particularly desirable, and such solid acidic catalysts include liquid acids which are supported on a solid substrate. The solid acidic catalysts are generally preferred over liquid catalysts because of the ease with which the feed can be contacted with such a material. For example, the feed can simply be passed through one or more fixed beds of solid particulate acidic catalyst at a suitable temperature. If desired, different acidic catalysts can be used in the various stages of the invention. For example, the severity of the alkylation conditions can be moderated in the alkylation step of the first stage through the use of a less active catalyst, while a more active catalyst can be used in the alkylation step of a secondary stage.

In one embodiment of the invention, a distillation column reactor is used for at least one of the stages of the invention. For example, one or more particulate fixed beds of solid acidic catalyst can be used as a column packing in a distillation column. By insertion of the catalyst into the distillation column, the column becomes a distillation column reactor. As a consequence, the acid catalyzed alkylation step of a stage of this invention can be carried out simultaneously with the fractional distillation of the resulting products by contacting the feed to that stage with the catalyst under suitable reaction conditions within the distillation column.

Catalysts which are suitable for use in the practice of the invention can be comprised of materials such as acidic polymeric resins, supported acids, and acidic inorganic oxides. Suitable acidic polymeric resins include the polymeric sulfonic acid resins which are well-known in the art and are commercially available. Amberlyst® 35, a product produced by Rohm and Haas Co., is a typical example of such a material.

Supported acids which are useful as catalysts include but are not limited to Bronsted acids (examples include phosphoric acid, sulfuric acid, boric acid, HF, fluorosulfonic acid, trifluoromethanesulfonic acid, and dihydroxyfluoroboric acid) and Lewis acids (examples include $BF_3$, $BCl_3$, $AlCl_3$, $AlBr_3$, $FeCl_2$, $FeCl_3$, $ZnCl_2$, $SbF_5$, $SbCl_5$ and combinations of $AlCl_3$ and HCl) which are supported on solids such as silica, alumina, silica-aluminas, zirconium oxide or clays. When supported liquid acids are employed, the supported catalysts are typically prepared by combining the desired liquid acid with the desired support and drying. Supported catalysts which are prepared by combining a phosphoric acid with a support are highly preferred and are referred to herein as solid phosphoric acid catalysts. These catalysts are preferred because they are both highly effective and low in cost. U.S. Pat. No. 2,921,081 (Zimmerschied et al.), which is incorporated herein by reference in its entirety, discloses the preparation of solid phosphoric acid catalysts by combining a zirconium compound selected from the group consisting of zirconium oxide and the halides of zirconium with an acid selected from the group consisting of orthophosphoric acid, pyrophosphoric acid and triphosphoric acid. U.S. Pat. No. 2,120,702 (Ipatieff et al.), which is incorporated herein by reference in its entirety, discloses the preparation of solid phosphoric acid catalysts by combining a phosphoric acid with a siliceous material. Finally, British Patent No. 863,539, which is incorporated herein by reference in its entirety, also discloses the preparation of a solid phosphoric acid catalyst by depositing a phosphoric acid on a solid siliceous material such as diatomaceous earth or kieselguhr.

With respect to a solid phosphoric acid that is prepared by depositing a phosphoric acid on kieselguhr, it is believed that the catalyst contains: (1) one or more free phosphoric acids (such as orthophosphoric acid, pyrophosphoric acid and triphosphoric acid) supported on kieselguhr; and (2) silicon phosphates which are derived from the chemical reaction of the acid or acids with the kieselguhr. While the anhydrous silicon phosphates are believed to be inactive as an alkylation catalyst, it is also believed that they can be hydrolyzed to yield a mixture of orthophosphoric and polyphosphoric acids which are catalytically active. The precise composition of this mixture will depend upon the amount of water to which the catalyst is exposed. In order to maintain a solid phosphoric acid alkylation catalyst at a satisfactory level of activity when it is used with a substantially anhydrous hydrocarbon feedstock, it is conventional practice to add a small amount of an alcohol, such as isopropyl alcohol, to the feedstock to maintain the catalyst at a satisfactory level of hydration. It is believed that the alcohol undergoes dehydration upon contact with the catalyst, and that the resulting water then acts to hydrate the catalyst. If the catalyst contains too little water, it tends to have a very high acidity which can lead to rapid deactivation as a consequence of coking and, in addition, the catalyst will not possess a good physical integrity. Further hydration of the catalyst serves to reduce its acidity and reduces its tendency toward rapid deactivation through coke formation. However, excessive hydration of such a catalyst can cause the catalyst to soften, physically agglomerate and create high pressure drops in fixed bed reactors. Accordingly, there is an optimum level of hydration for a solid phosphoric acid catalyst, and this level of hydration will be a function of the reaction conditions, the substrate, and the alkylating agent. Although the invention is not to be so limited, with solid phosphoric acid catalysts, we have found that a water concentration in the feedstock which is in the range from about 50 to about 1,000 ppm is generally satisfactory, and that this water is conveniently provided in the form of an alcohol such as isopropyl alcohol.

Acidic inorganic oxides which are useful as catalysts include but are not limited to aluminas, silica-aluminas, natural and synthetic pillared clays, and natural and synthetic zeolites such as faujasites, mordenites, L, omega, X, Y, beta, and ZSM zeolites. Highly suitable zeolites include beta, Y, ZSM-3, ZSM-4, ZSM-5, ZSM-1 8, and ZSM-20. If desired, the zeolites can be incorporated into an inorganic oxide matrix material such as a silica-alumina. Indeed, equilibrium cracking catalyst can be used as the acid catalyst in the practice of this invention.

Catalysts can comprise mixtures of different materials, such as a Lewis acid (examples include $BF_3$, $BCl_3$, $SbF_5$, and $AlCl_3$), a nonzeolitic solid inorganic oxide (such as silica, alumina and silica-alumina), and a large-pore crystalline molecular sieve (examples include zeolites, pillared clays and aluminophosphates).

In the event that a solid catalyst is used, it will desirably be in a physical form which will permit a rapid and effective contacting with the reactants in the process stage wherein it is used. Although the invention is not to be so limited, it is preferred that a solid catalyst be in particulate form wherein the largest dimension of the particles has an average value which is in the range from about 0.1 mm to about 2 cm. For example, substantially spherical beads of catalyst can be used which have an average diameter from about 0.1 mm to about 2 cm. Alternatively, the catalyst can be used in the form of rods which have a diameter in the range from about 0.1 mm to about 1 cm and a length in the range from about 0.2 mm to about 2 cm.

Feedstocks which are used in the practice of this invention will occasionally contain nitrogen-containing organic compounds as impurities in addition to the sulfur-containing aromatic impurities. Many of the typical nitrogen-containing impurities are organic bases and, in some instances, can cause deactivation of the acidic catalyst or catalysts of the subject invention. In the event that such deactivation is observed, it can be prevented by removal of the basic nitrogen-containing impurities before they can contact the acidic catalyst. These basic impurities are most conveniently removed from the feedstock before it is utilized in the practice of the invention. A highly preferred feedstock for use in the invention is comprised of a treated naphtha which is prepared by removing basic nitrogen-containing impurities from a naphtha produced by a catalytic cracking process.

The basic nitrogen-containing impurities can be removed by any conventional method. Such methods typically involve treatment with an acidic material, and conventional methods include procedures such as washing with an aqueous solution of an acid and the use of a guard bed which is positioned in front of the acidic catalyst. Examples of effective guard beds include but are not limited to A-zeolite, Y-zeolite, L-zeolite, mordenite, fluorided alumina, fresh cracking catalyst, equilibrium cracking catalyst and acidic polymeric resins. If a guard bed technique is employed, it is often desirable to use two guard beds in such a manner that one guard bed can be regenerated while the other is being used to pretreat the feedstock and protect the acidic catalyst. If a cracking catalyst is utilized to remove basic nitrogen-containing impurities, such a material can be regenerated in the regenerator of a catalytic cracking unit when it has become deactivated with respect to its ability to remove such impurities. If an acid wash is used to remove basic nitrogen-containing compounds, the feedstock will be treated with an aqueous solution of a suitable acid. Suitable acids for such use include but are not limited to hydrochloric acid, sulfuric acid and acetic acid. The concentration of acid in the aqueous solution is not critical, but is conveniently chosen to be in the range from about 0.5 to about 30% by weight. For example, a 2% by weight solution of sulfuric acid in water can be used to remove basic nitrogen containing compounds from a heavy naphtha from a catalytic cracking process.

In the practice of this invention, the feed to the alkylation step of each stage is contacted with the acidic catalyst at a temperature and for a period of time which are effective to result in the desired degree of conversion of sulfur-containing aromatic impurities to a higher boiling sulfur-containing material. However, it will be appreciated that the temperature and contact time can be selected in such a way that the alkylation conditions in the alkylation step of the first stage of the invention are less severe than in that of a secondary stage or stages, and this can be achieved by using a lower temperature and/or shorter contact time in the alkylation step of the first stage. Irrespective of the specific alkylation step of the invention, the contacting temperature will be desirably in excess of about 50° C., preferably in excess of 100° C., and more preferably in excess of 125° C. The contacting will generally be carried out at a temperature in the range from about 50° to about 350° C., preferably from about 100° to about 350° C., and more preferably from about 125° to about 250° C. It will be appreciated, of course, that the optimum temperature will be a function of the acidic catalyst used, the alkylating agent or agents selected, the concentration of alkylating agent or agents, and the nature of the sulfur-containing aromatic impurities that are to be removed.

In the event that a stage of the process is carried out with a distillation column reactor, the pressure at which the distillation column reactor is operated can be used to control both the distillation temperature and the temperature at which the acidic catalyst is contacted by the reactants in the distillation column reactor. By increasing the pressure, a higher temperature will be required to effect fractional distillation in the distillation column reactor.

Any desired amount of alkylating agent can be used in the practice of this invention. However, the use of large amounts of alkylating agent relative to the amount of sulfur-containing impurities in an alkylation step will serve to increase the severity of the alkylation conditions and promote a more rapid and complete conversion of the sulfur-containing aromatic impurities to higher boiling sulfur-containing products upon contact with the acidic catalyst. Accordingly, the concentration of alkylating agent is one of the variables that can be used to control the severity of the alkylation conditions in the alkylation step of the various stages of the invention. However, the feed to any particular alkylation step will desirably contain an amount of alkylating agent which is at least equal on a molar basis to that of the sulfur-containing aromatic impurities in the feed. If desired, the molar ratio of alkylating agent to sulfur-containing aromatic impurities can be at least 5 or even larger. For example, in the alkylation step of a secondary stage wherein severe alkylation conditions are desired, the feed can be comprised of from about 10 to about 50 vol. % of olefins which contain from 3 to 5 carbon atoms. In a preferred embodiment, an olefinic alkylating agent will be used, and the molar concentration of olefins in the feed to the alkylation step of the first stage will be lower than that in the feed to the alkylation step of a secondary stage.

In the practice of this invention, the feed to an alkylation step can be contacted with the acidic catalyst at any suitable pressure. However, pressures in the range from about 0.01 to about 200 atmospheres are desirable, and a pressure in the range from about 1 to about 100 atmospheres is preferred. When the feed is simply allowed to flow through a catalyst bed, it is generally preferred to use a pressure at which the feed will be a liquid. However, if a stage of the invention is carried out in a distillation column reactor, the temperature and pressure at which the feed is contacted with the solid acidic catalyst in the distillation column reactor are selected so that: (1) the temperature is high enough to provide reaction conditions which are of appropriate severity for the alkylation step in question; and (2) the desired fractional distillation occurs.

In the event that a distillation column reactor is used in one or more of the stages of the invention, a solid acidic catalyst can be placed in the distillation column reactor in any conventional manner and can be located in a single contacting zone or a plurality of contacting zones within the reactor. For example, the catalyst can be placed on the trays of a conventional distillation column or within at least one conduit which provides a path for the flow of liquid from one zone to another within the distillation column reactor. If desired, such conduits can be located external to the main structure of the distillation column reactor so that each is accessible and can be independently taken out of service for replacement of the acidic solid catalyst without shutting down the distillation column reactor. As noted, it will usually be desirable to use at least two such conduits which contain the catalyst so that deactivated or spent catalyst in one conduit can be replaced or regenerated while the additional conduit or conduits permit continued operation of the distillation column reactor. Alternatively, the conduits can take the form of downcomers which connect adjacent trays and provide a path for the flow of liquid within a conventional distillation column. The use of downcomers to hold the catalyst in a distillation column reactor is described in U.S. Pat. No. 3,629,478 (Haunschild) and U.S. Pat. No. 3,634,534 (Haunschild), and these patents are incorporated herein by reference in their entirety. In a preferred embodiment, a solid acidic catalyst is used as a packing for the distillation column, and fractionation is carried out, at least in part, in the presence of the catalyst. For example, the solid acidic catalyst can be in the form of pellets, rods, rings, saddles, balls, irregular pieces, sheets, tubes, spirals, packed in bags, or deposited on grills or screens. The use of a catalyst as a packing material in a distillation column reactor is described in U.S. Pat. No. 4,232,177 (Smith), U.S. Pat. No. 4,242,530 (Smith), U.S. Pat. No. 4,307,254 (Smith) and U.S. Pat. No. 4,336,407 (Smith), and these patents are incorporated herein by reference in their entirety.

This invention represents a method for concentrating the sulfur-containing aromatic impurities of a hydrocarbon feedstock into a relatively small volume of high boiling material. As a result of this concentration, the sulfur can be disposed of more easily and at lower cost, and any conventional method can be used for this disposal. For example, this material can be blended into heavy fuels where the sulfur content will be less objectionable. Alternatively, it can be efficiently hydrotreated at relatively low cost because of its reduced volume relative to that of the original feedstock.

A highly preferred embodiment of this invention comprises its use to remove sulfur-containing aromatic compounds from the hydrocarbon products that result from the fluidized catalytic cracking of hydrocarbon feedstocks which contain sulfur-containing impurities. In fluidized catalytic cracking processes, high molecular weight hydrocarbon liquids or vapors are contacted with hot, finely divided, solid catalyst particles, typically in a fluidized bed reactor or in an elongated riser reactor, and the catalyst-hydrocarbon mixture is maintained at an elevated temperature in a fluidized or dispersed state for a period of time sufficient to effect the desired degree of cracking to low molecular weight hydrocarbons of the kind typically present in motor gasoline and distillate fuels.

Conversion of a selected hydrocarbon feedstock in a fluidized catalytic cracking process is effected by contact with a cracking catalyst in a reaction zone at conversion temperature and at a fluidizing velocity which limits the conversion time to not more than about ten seconds. Conversion temperatures are desirably in the range from about 430° to about 700° C. and preferably from about 450° to about 650° C. Effluent from the reaction zone, comprising hydrocarbon vapors and cracking catalyst containing a deactivating quantity of carbonaceous material or coke, is then transferred to a separation zone. Hydrocarbon vapors are separated from spent cracking catalyst in the separation zone and are conveyed to a fractionator for the separation of these materials on the basis of boiling point. These volatile hydrocarbon products typically enter the fractionator at a temperature in the range from about 430° to about 650° C. and supply all of the heat necessary for fractionation.

In the catalytic cracking of hydrocarbons, some non-volatile carbonaceous material or coke is deposited on the catalyst particles. As coke builds up on the cracking catalyst, the activity of the catalyst for cracking and the selectivity of the catalyst for producing gasoline blending stocks diminishes. The catalyst can, however, recover a major portion of its original catalytic activity by removal of most of the coke from it. This is carried out by burning the coke deposits from the catalyst with a molecular oxygen-containing regeneration gas, such as air, in a regeneration zone or regenerator.

A wide variety of process conditions can be used in the practice of the fluidized catalytic cracking process. In the usual case where a gas oil feedstock is employed, the throughput ratio, or volume ratio of total feed to fresh feed, can vary from about 1.0 to about 3.0. Conversion level can vary from about 40% to about 100% where conversion is defined as the percentage reduction of hydrocarbons boiling above 221° C. at atmospheric pressure by formation of lighter materials or coke. The weight ratio of catalyst to oil in the reactor can vary within the range from about 2 to about 20 so that the fluidized dispersion will have a density in the range from about 15 to about 320 kilograms per cubic meter. Fluidizing velocity can be in the range from about 3.0 to about 30 meters per second.

A suitable hydrocarbon feedstock for use in a fluidized catalytic cracking process can contain from about 0.2 to about 6.0 weight percent of sulfur in the form of organic sulfur compounds. Suitable feedstocks include but are not limited to sulfur-containing petroleum fractions such as light gas oils, heavy gas oils, wide-cut gas oils, vacuum gas oils, naphthas, decanted oils, residual fractions and cycle oils derived from any of these as well as sulfur-containing hydrocarbon fractions derived from synthetic oils, coal liquefaction and the processing of oil shale and tar sands. Any of these feedstocks can be employed either singly or in any desired combination.

While this invention is susceptible of embodiment in many forms, a specific embodiment is shown schematically in FIG. 1, with the understanding that the present disclosure is not intended to limit the invention to the embodiment illustrated.

With reference to FIG. 1, a gas oil which contains organic sulfur compounds as impurities is catalytically cracked in a fluidized catalytic cracking process, and the volatile products from this process are passed through line 1 into distillation column 2. A feedstock, which boils over the range from about 60° C. to about 221° C. is withdrawn from distillation column 2 through line 3. The feedstock contains both thiophenic and benzothiophenic compounds as impurities and has an olefin content in the range from about 5 to about 25 wt. %. Low boiling material having a boiling point below about 60° C. is withdrawn from distillation column 2 through line 4, and high-boiling material with a boiling point in excess of about 221° C. is withdrawn through line 5.

The feedstock is passed through line 3 and is introduced into alkylation reactor 6, which contains an acidic catalyst. The feedstock is passed through reactor 6 where it contacts the acidic catalyst under reaction conditions which are effective to convert a portion of the thiophenic and benzothiophenic impurities to a sulfur-containing material of higher boiling material through alkylation by the olefins in the feedstock. A substantial portion of the more volatile thiophenic impurities, which are typically the most reactive of the thiophenic and benzothiophenic impurities, are alkylated in reactor 6. The products from alkylation reactor 6 are discharged through line 7 and are passed to distillation column 8 where these products are fractionally distilled. A high boiling fraction, which has an initial boiling point of about 177° C. and comprises a hydrocarbon mixture which contains both unalkylated sulfur-containing impurities and alkylated sulfur-containing impurities, is withdrawn from distillation column 8 through line 9. A low boiling fraction, which is of reduced sulfur content relative to the sulfur content of the first feedstock fraction and has a distillation endpoint of about 177° C., is withdrawn from distillation column 8 through line 10. If desired, this low boiling fraction from line 10 can be used as a low sulfur gasoline blending stock.

The high boiling fraction from distillation column 8 is passed through line 9 and is mixed with from about 10 to about 50 vol. % of propene which is introduced through line 11. The resulting mixture is introduced into alkylation reactor 12 through line 13.

Alkylation reactor 12 contains an acidic catalyst, and the mixture entering this reactor as a feed from line 13 contacts the acidic catalyst under reaction conditions which are effective to convert a portion of the thiophenic and benzothiophenic impurities in the mixture to a sulfur-containing material of higher boiling point through alkylation by the olefins in the mixture. The products from alkylation reactor 12 are discharged through line 14 and are passed to distillation column 15 where these products are fractionally distilled. A high boiling fraction, which has an initial boiling point of about 221° C. and contains the high boiling alkylated thiophenic and benzothiophenic products, is withdrawn from distillation column 15 through line 16. If desired, this high boiling material can be conveyed to a hydrotreating unit for removal of at least a portion of its sulfur content. A low boiling fraction, which has a reduced sulfur content relative to that of the mixture introduced into reactor 12 through line 13, is withdrawn from distillation column 15 through line 17. The low boiling fraction discharged through line 17 has a distillation endpoint of about 221° C. and, after removal of excess propene, consists primarily of material boiling from about 177° C. to about 221° C. which can be used as a gasoline blending stock.

The following examples are intended only to illustrate the invention and are not to be construed as imposing limitations on the invention.

EXAMPLE I

A naphtha feedstock, boiling over the range from about 61° to about 226° C., was obtained by: (1) fractional distillation of the products from the fluidized catalytic cracking of a gas oil feedstock which contained sulfur-containing impurities; and (2) washing the distillate with a 2 wt. % aqueous sulfuric acid solution in a drum mixer. Analysis of the naphtha feedstock using a multicolumn gas chromatographic technique showed it to contain on a weight basis: 12.67% paraffins, 20.36% olefins, 11.93% naphthenes, 50.89% aromatics, and 4.14% unidentified $C_{12}$+ high boiling material. The total sulfur content of the naphtha, as determined by X-ray fluorescence spectroscopy, was 1,644 ppm, and about 90% of this sulfur content (i.e., 1,480 ppm) was in the form of thiophene, thiophene derivatives, benzothiophene and benzothiophene derivatives (collectively referred to as thiophenic/benzothiophenic sulfur). All of the sulfur-containing components which were not thiophenic/benzothiophenic in character (such as mercaptans, sulfides and disulfides) had a boiling point below 177° C. The naphtha had a total nitrogen content of 8 ppm and a basic nitrogen content of less than 5 ppm.

In a first stage, the naphtha feedstock was combined with 670 ppm of isopropyl alcohol, and the resulting mixture was contacted with a fixed bed of 12 to 18 mesh solid phosphoric acid catalyst on kieselguhr (obtained from UOP and sold under the name SPA-2) at a temperature of 204° C., a pressure of 34 atm, and a liquid hourly space velocity of 1.0 $hr^{-1}$. The small amount of isopropyl alcohol was used to maintain catalyst activity, and it is believed that the alcohol undergoes dehydration upon contact with the catalyst and that the resulting 200 ppm of water serves to maintain catalyst hydration at a satisfactory level. In addition, the isopropyl alcohol supplements the olefins in the feedstock as an alkylating agent. The catalyst bed had a volume of 20 $cm^3$ and was held between two beds of inert alumina packing in a tubular, stainless steel reactor of 1.58 cm internal diameter. The reactor had a total internal heated volume of about 80 $cm^3$ and was held in a vertical orientation. The resulting product was separated into two fractions by fractional distillation: (1) 70% of the product as a first fraction with a distillation endpoint of 177° C.; and (2) 30% of the product as a second fraction with an initial boiling point of 177° C. The first fraction is referred to herein as the "177° C.-(−) first stage product," and the second fraction is referred to herein as the "177° C.-(+) first stage product." Upon analysis, it was found that the 177° C.-(−) first stage product contained only about 211 ppm by weight of thiophenic/ benzothiophenic sulfur. In contrast, the 177° C.-(+) first stage product contained about 4,439 ppm by weight of thiophenic/benzothiophenic sulfur, and about 1,198 ppm by weight of this thiophenic/benzothiophenic sulfur was present in the form of material which had a boiling point in the range from 177° to 221° C.

The 177° C.-(+) first stage product was combined with 10 vol. % of propene and 670 ppm by of isopropyl alcohol, and the resulting mixture was used as a second stage feedstock. In a second stage, the second stage feedstock was contacted with a fixed bed of 12 to 18 mesh solid phosphoric acid catalyst on kieselguhr (obtained from UOP and sold under the name SPA-2) using the same reaction conditions and reactor described above for the first stage. The resulting product was fractionated on the basis of boiling point by gas chromatography, and the sulfur content of the fractions was determined using a sulfur chemiluminescence detector. Using this analytical procedure, the product was separated into two fractions: (1) a first fraction with a distillation endpoint of 221° C.; and (2) a second fraction with an initial boiling point of 221° C. The first fraction is referred to herein as the "221° C.-(−) second-stage product," and the second fraction is referred to herein as the "221° C.-(+) second-stage product." It was found that about 17% of the thiophenic/benzothiophenic sulfur in the second stage feedstock which had a boiling point below 221 ° C. was converted to high boiling material which appeared in the high boiling 221° C.-(+) second-stage product. The 221° C.-(−) second-stage product contained about 994 ppm by weight of thiophenic/benzothiophenic sulfur. In contrast, the 221° C.-(+) second-stage product contained about 29,600 ppm by weight of thiophenic/benzothiophenic sulfur.

The total low sulfur product from the process consisted of the combination of the 177° C.-(−) first stage product and the 221° C.-(−) second-stage product. This total low sulfur product contained 425 ppm by weight of thiophenic/benzothiophenic sulfur, which corresponds to a 72% removal of the thiophenic/benzothiophenic sulfur in the original naphtha feedstock. In addition, the total low sulfur product was obtained in 96.4% yield based on the weight of the original naphtha feedstock. Accordingly, 3.6 wt. % of the original naphtha feedstock was converted to a high boiling and high sulfur content material in the form of the 221° C.-(+) second-stage product. The 221° C.-(+) second-stage product contained 2.96 wt. % of thiophenic/benzothiophenic sulfur. The results of this Example I are summarized in TABLE I.

EXAMPLE II

A sample of the naphtha feedstock described in Example I above was combined with 670 ppm of isopropyl alcohol, and the resulting mixture was contacted with a fixed bed of 12 to 18 mesh solid phosphoric acid catalyst on kieselguhr (obtained from UOP and sold under the name SPA-2) at a temperature of 204° C., a pressure of 34 atm, and a liquid hourly space velocity of 1.0 $hr^{-1}$ in a reactor of the type described in Example I. The resulting product was fractionated on the basis of boiling point by gas chromatography and the sulfur content of the fractions determined using a sulfur chemiluminescence detector. Using this analytical procedure, the product was separated into two fractions: (1) a first fraction boiling up to 221° C.; and (2) a second fraction boiling above 221° C. The first fraction is referred to herein as the "221° C.-(−) product," and the second fraction is referred to herein as the "221° C.-(+) product." It was found that 66.7 wt. % of the thiophenic/benzothiophenic sulfur in the naphtha was converted to high boiling material which appeared in the 221° C.-(+) product. The 221° C.-(−) product contained 567 ppm by weight of thiophenic/benzothiophenic sulfur, and the 221° C.-(+) product contained 1.75 wt. % of thiophenic/benzothiophenic sulfur. In addition, the total low sulfur product was obtained in 94.0% yield based on the weight of the original naphtha feedstock. Accordingly, 6.0 wt. % of the original naphtha feedstock was converted to a high boiling and high sulfur content material in the form of the 221° C.-(+) product. The results of this Example II are summarized in TABLE I.

TABLE I

Summary of Results from Examples I, II and III.

| Process Stream | Separation of Process Stream into Fractions by Simulated Distillation, and Analysis of Resulting Fractions[1] | | |
|---|---|---|---|
| | Boiling Point of Fraction[2] | Amount of Fraction, wt. % | Sulfur Content[3] of Fraction, ppm |
| Naphtha Feedstock | IBP-221° C. | 99.0 | 1,346 |
| | 221° C.-(+) | 1.0 | 16,440 |
| Product of Example I | IBP-221° C.[4] | 96.4 | 425 |
| | 221° C.-(+) | 3.6 | 29,600 |
| Product of Example II | IBP-221° C. | 94.0 | 567 |
| | 221° C.-(+) | 6.0 | 17,536 |
| Product of Example III | IBP-221° C. | 91.0 | 537 |
| | 221° C.-(+) | 9.0 | 12,239 |

[1]The analytical data were obtained using a gas chromatograph equipped with a flame ionization detector, a wide-bore fused-silica capillary column, direct injector, and a sulfur chemiluminescence detector. The analytical method is based on a retention time versus boiling point calibration of the chromatographic system.
[2]IBP-221° C. refers to the total fraction boiling up to 221° C.; and 221° C.-(+) refers to the total fraction boiling above 221° C.-(+).
[3]"Sulfur Content" refers to thiophenic/benzothiophenic sulfur content.
[4]The IBP-221° C. fraction from the process consists of the combination of the 177° C.-(−) first stage product and the 221° C.-(−) second-stage product.

The alkylation procedure of this Example II involves a single stage alkylation of the thiophenic and benzothiophenic components of the naphtha feedstock wherein the alkylating agent consists of the olefins which are inherently present in the naphtha feedstock. Comparison of the single stage alkylation procedure of this Example II with the two stage alkylation procedure of Example I demonstrates that the two stage procedure is much more satisfactory because: (1) the product has a lower thiophenic/benzothiophenic sulfur content; and (2) there is a much smaller weight loss when the naphtha starting material is subjected to the two stage process.

EXAMPLE III

A sample of the naphtha feedstock described in Example I above was mixed with 10 vol. % propene and 670 ppm of isopropyl alcohol, and the resulting mixture was contacted with a fixed bed of 12 to 18 mesh solid phosphoric acid catalyst on kieselguhr (obtained from UOP and sold under the name SPA-2) at a temperature of 204° C., a pressure of 34 atm, and a liquid hourly space velocity of 1.0 $hr^{-1}$ in a reactor of the type described in Example I. The resulting product was fractionated on the basis of boiling point by gas chromatography, and the sulfur content of the fractions was determined using a sulfur chemiluminescence detector. Using this analytical procedure, the product was separated into two fractions: (1) a first fraction boiling up to 221° C.; and (2) a second fraction boiling above 221° C. The first fraction is referred to herein as the "221° C.-(−) product," and the second fraction is referred to herein as the "221°

C.-(+) product." It was found that 70.4 wt. % of the thiophenic/benzothiophenic sulfur in the naphtha was converted to high boiling material which appeared in the 221° C.-(+) product. The 221 ° C.-(−) product contained 537 ppm by weight of thiophenic/benzothiophenic sulfur, and the 221° C.-(+) product contained 1.22 wt. % of thiophenic/benzothiophenic sulfur. The 221° C.-(−) product was obtained in 91.0% yield based on the weight of the original naphtha feedstock. In addition, a 9.0 wt. % yield of a high boiling and high sulfur content material was obtained in the form of the 221° C.-(+) product. The results of this Example III are summarized in TABLE I.

The alkylation procedure of this Example III involves a single stage alkylation of the thiophenic and benzothiophenic components of the naphtha feedstock wherein the alkylating agent consists of the olefins inherently present in the naphtha feedstock and also the added propene. Comparison of the results of the single stage alkylation procedure of this Example III with the two stage alkylation procedure of Example I demonstrates that the two stage procedure is much more satisfactory because: (1) the product has a lower thiophenic/benzothiophenic sulfur content; and (2) there is a larger yield of desirable volatile product when the naphtha starting material is subjected to the two stage process.

EXAMPLE IV

A synthetic feedstock was prepared by blending model compounds which were selected to be representative of the types and concentrations of the various organic compounds which are found in a typical heavy naphtha that is produced by the fluidized catalytic cracking process. The composition of the synthetic feedstock is set forth in Table II.

TABLE II

Synthetic feedstock composition.

| Component | Wt. % | Mole % |
|---|---|---|
| 1-Pentene | 1.0 | 1.31 |
| 1-Hexene | 2.00 | 2.18 |
| 1-Heptene | 2.50 | 2.33 |
| 1-Octene | 3.50 | 2.86 |
| Cyclohexene | 4.00 | 4.46 |
| n-Heptane | 10.00 | 9.14 |
| n-Octane | 15.00 | 12.03 |
| Methylcyclopentane | 10.00 | 10.88 |
| Benzene | 20.00 | 23.44 |
| Toluene | 30.00 | 29.81 |
| Thiophene | 0.20 | 0.22 |
| Ethylthiophene | 0.80 | 0.65 |
| Benzothiophene | 1.00 | 0.68 |

Figure 2:
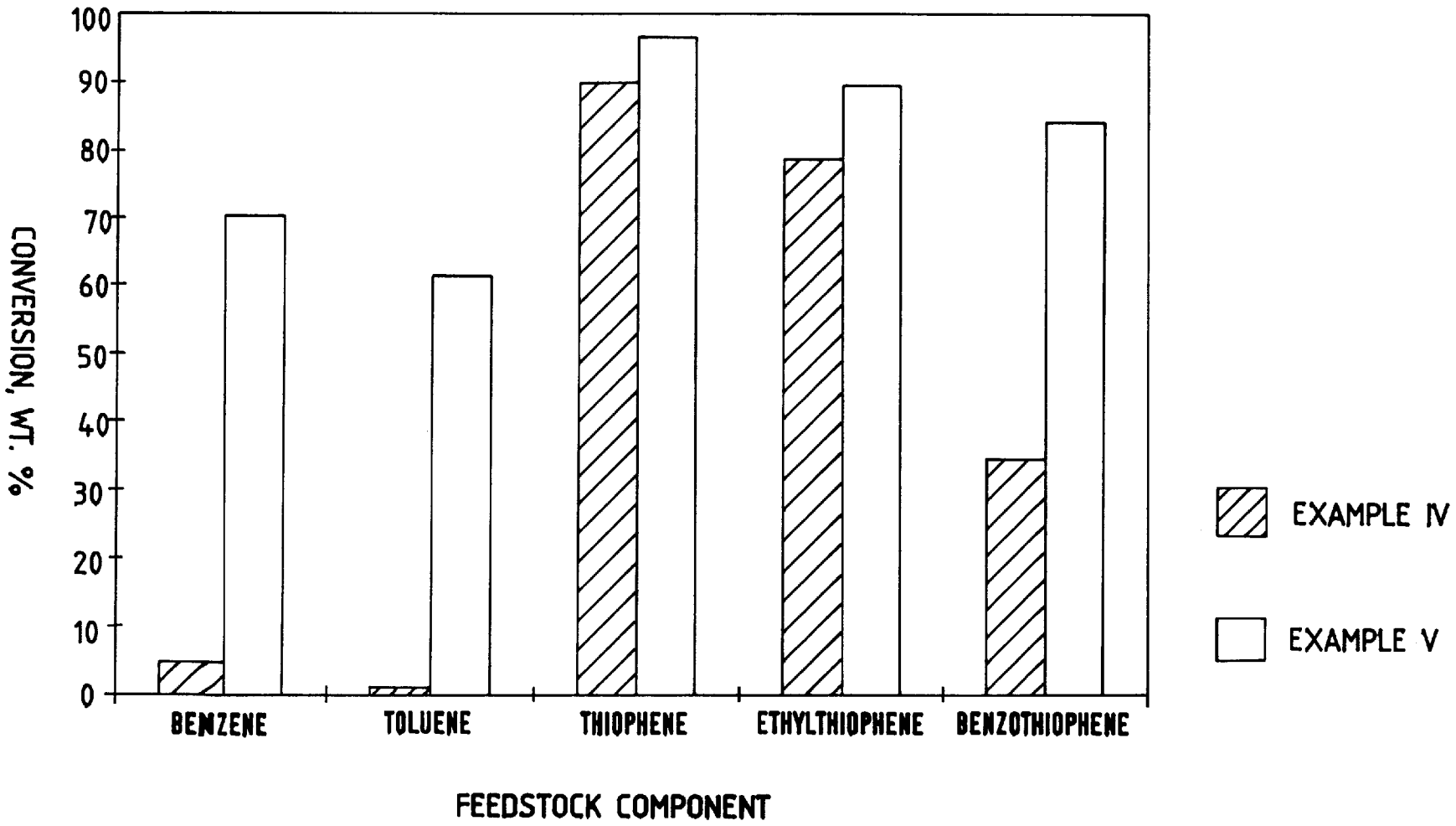
FIG. 2 of the drawings compares the conversion of benzene, toluene, thiophene, ethylthiophene and benzothiophene to higher boiling products by alkylation with $C_5$–$C_8$ olefins both in the presence and in the absence of added propene.

The synthetic feedstock was combined with 1,730 ppm of isopropyl alcohol, and the resulting mixture was contacted with a fixed bed of 12 to 18 mesh solid phosphoric acid catalyst on kieselguhr (obtained from UOP and sold under the name SPA-2) at a temperature of 204° C., a pressure of 54 atm, and a liquid hourly space velocity of 4.0 $hr^{-1}$. The resulting product was analyzed using a capillary gas chromatograph which was calibrated using the synthetic feedstock. Upon analysis, it was found that benzene, toluene, thiophene, ethylthiophene and benzothiophene had been converted to higher boiling material in the following amounts: benzene (4.49 wt. %), toluene (0.68 wt. %), thiophene (89.83 wt. %), ethylthiophene (78.37 wt. %), and benzothiophene (34.34 wt. %). These results are set forth in FIG. 2. This example demonstrates that thiophene and ethylthiophene are alkylated by olefins more easily than benzothiophene. In addition, the results of this example demonstrate that thiophene and ethylthiophene can be alkylated by olefins in high yield under conditions which are sufficiently mild that very little alkylation of benzene and toluene takes place.

EXAMPLE V

The synthetic feedstock described in Example IV above was mixed with 20 vol. % of propene and 1,730 ppm of isopropyl alcohol, and the resulting mixture was contacted with a fixed bed of 12 to 18 mesh solid phosphoric acid catalyst on kieselguhr (obtained from UOP and sold under the name SPA-2) at a temperature of 204° C., a pressure of 54 atm, and a liquid hourly space velocity of 4.0 $hr^{-1}$. Upon analysis of the product by capillary gas chromatography, it was found that benzene, toluene, thiophene, ethylthiophene and benzothiophene had been converted to higher boiling material in the following amounts: benzene (70.31 wt. %), toluene (61.13 wt. %), thiophene (96.51 wt. %), ethylthiophene (89.47 wt. %), and benzothiophene (84.06 wt. %). These results are set forth in FIG. 2.

As a consequence of the high concentration of olefin alkylating agent used in this Example V, the alkylation conditions are more severe than those used in Example IV above. This example demonstrates that benzothiophene can be alkylated by olefins in high yield under the more severe reaction conditions of this Example V. However, these more severe alkylation conditions result in a high conversion of benzene and toluene (aromatic hydrocarbons) to alkylation products.

EXAMPLE VI

A synthetic feedstock was prepared by dissolving 0.499 g of thiophene, 0.522 g of 2-methylthiophene, 0.501 g of 2,5-dimethylthiophene, 0.518 g of benzothiophene, 0.509 g of benzene, 0.614 g of toluene and 10.014 g of 1-heptene in 87.015 g of decane. A 50 g portion of the synthetic feedstock was combined with 25 g of solid phosphoric acid catalyst on kieselguhr (obtained from UOP and sold under the name SPA-2) which had been crushed and sieved to 12–20 mesh size. The resulting mixture was placed in a 100 $cm^3$ stirred autoclave reactor which was equipped with a dip leg for on-line sampling of the reaction mixture, and the mixture was stirred at 500 rpm under nitrogen at 204° C. and a pressure of 54.4 atm. The reaction mixture was sampled periodically by temporarily stopping the stirring, allowing the catalyst to settle, and removing about 2 g of the liquid. Each sample was analyzed by gas chromatography to measure changes in the concentration of the various reactants. The resulting analytical data was used to calculate the alkylation rate constants which are set forth in Table III for the alkylation of the various aromatic compounds in the feedstock by 1-heptene. In calculating these rate constants, it was assumed that the alkylation reactions were pseudo-first order in aromatic substrate as a consequence of the large excess of olefinic alkylating agent that was used. Each rate constant was derived from the slope of the line fit through linear regression of the experimental data plotted as $\ln(1-x)$ as a function of time where x is the substrate concentration. The boiling points of the various aromatic components of the synthetic feedstock are also set forth in Table III. These results demonstrate that volatile thiophenic compounds, such as thiophene and 2-methylthiophene, are much more reactive than the less volatile benzothiophene.

TABLE III

Boiling points and alkylation rate constants for various aromatic compounds.

| Compound | Boiling Point, ° C. | Rate Constant, $min^{-1}$ |
|---|---|---|
| Thiophene | 84 | 0.077 |
| 2-Methylthiophene | 113 | 0.046 |
| 2,5-Dimethylthiophene | 137 | 0.004 |
| Benzothiophene | 221 | 0.008 |
| Benzene | 80 | 0.001 |
| Toluene | 111 | 0.002 |

We claim:

1. A process for producing products of reduced sulfur content from a feedstock, wherein said feedstock is comprised of a mixture of hydrocarbons which includes olefins, and wherein the feedstock contains sulfur-containing aromatic compounds as impurities; said process comprising:

(a) in a first contacting step, contacting the feedstock with an acidic catalyst under conditions which are effective to convert a portion of the impurities to a sulfur-containing material of higher boiling point through alkylation by the olefins;

(b) in a first fractionation step, fractionating the product of said first contacting step on the basis of boiling point into at least two fractions which include:

(i) a first fraction which is comprised of hydrocarbons and has a reduced sulfur content relative to that of said feedstock; and (ii) a second fraction which is comprised of hydrocarbons, has a higher boiling point than that of said first fraction and contains sulfur-containing aromatic compounds as impurities;

(c) withdrawing said first fraction from the process as a first product stream of reduced sulfur content;

(d) preparing a secondary process stream by combining said second fraction with a secondary alkylating agent which is comprised of at least one material selected from the group consisting of alcohols and olefins, and wherein said secondary alkylating agent is in addition to any olefins present in the second fraction;

(e) in a second contacting step, contacting the secondary process stream with an acidic catalyst under conditions which are effective to convert at least a portion of the sulfur-containing aromatic compounds in said secondary process stream to a sulfur-containing material of higher boiling point;

(f) in a second fractionation step, fractionating the product of said second contacting step on the basis of boiling point to remove high boiling sulfur-containing material in a high boiling fraction and produce a lower boiling fraction; and (g) withdrawing the lower boiling fraction from the second fractionation step as a second product stream of reduced sulfur content.

2. The process of claim 1 wherein the olefin content of the feedstock is at least equal on a molar basis to that of the sulfur-containing aromatic compounds.

3. The process of claim 1 wherein the feedstock has an olefin content of from about 5 to about 25 wt. %.

4. The process of claim 1 wherein said feedstock is comprised of a naphtha from a catalytic cracking process.

5. The process of claim 1 wherein the feedstock is comprised of a treated naphtha which is prepared by removing basic nitrogen-containing impurities from a naphtha produced by a catalytic cracking process.

6. The process of claim 1 wherein the first fraction from said first fractionation step has a distillation endpoint which is in the range from about 135° C. to about 221° C.

7. The process of claim 6 wherein the first fraction from said first fractionation step has a distillation endpoint which is in the range from about 150° C. to about 190° C.

8. The process of claim 1 wherein said feedstock has an initial boiling point which is below about 79° C. and has a distillation endpoint which is about 249° C. or lower.

9. The process of claim 1 wherein the feedstock has a distillation endpoint which is about 345° C. or lower.

10. The process of claim 1 wherein the secondary alkylating agent is comprised of at least one material selected from the group consisting of olefins which contain from 3 to 5 carbon atoms.

11. The process of claim 10 wherein the molar concentration of olefins in the feedstock is lower than that in said secondary process stream.

12. The process of claim 10 wherein the secondary process stream is comprised of from about 10 to about 50 vol. % of olefins which contain from 3 to 5 carbon atoms.

13. The process of claim 1 wherein the secondary alkylating agent is comprised of at least one material selected from the group consisting of alcohols which contain from 3 to 20 carbon atoms.

14. The process of claim 1 wherein the temperature used in said second contacting step is higher than that used in said first contacting step.

15. The process of claim 1 wherein the acidic catalyst of said first contacting step is different from that of said second contacting step.

16. The process of claim 1 wherein a solid phosphoric acid catalyst is used as the acidic catalyst in at least one of said first and second contacting steps.

17. The process of claim 1 wherein said the first contacting step and the first fractionation step are carried out in a distillation column reactor.

18. The process of claim 1 wherein the second contacting step and the second fractionation step are carried out in a distillation column reactor.

19. The process of claim 1 wherein the feedstock contains benzothiophene as one of said sulfur-containing aromatic compounds, and the second fraction from said first fractionation step includes a major portion of said benzothiophene.

20. The process of claim 1 wherein an acidic polymeric resin is used as the acidic catalyst in at least one of said first and second contacting steps.

21. The process of claim 1 wherein the alkylation conditions are less severe in the first contacting step than in the second contacting step.

* * * * *